US006796423B2

(12) United States Patent
Miller

(10) Patent No.: US 6,796,423 B2
(45) Date of Patent: Sep. 28, 2004

(54) PACKAGE FOR DISPLAYING PRODUCTS

(76) Inventor: Alan Miller, 261 El Bravo Way, Palm Beach, FL (US) 33480

( * ) Notice: Subject to any disclaimer, the term of this patent is extended or adjusted under 35 U.S.C. 154(b) by 149 days.

(21) Appl. No.: 10/199,825

(22) Filed: Jul. 19, 2002

(65) Prior Publication Data

US 2004/0011675 A1 Jan. 22, 2004

(51) Int. Cl.[7] ..... B65D 81/26

(52) U.S. Cl. ..... 206/204; 206/497; 206/526; 206/770; 426/121; 426/129

(58) Field of Search ..... 206/204, 483, 206/497, 526, 778, 770; 426/121, 129

(56) References Cited

U.S. PATENT DOCUMENTS

| | | | | |
|---|---|---|---|---|
| 3,575,287 | A | 4/1971 | Graveley | |
| 3,700,096 | A | 10/1972 | Reifers | |
| 4,125,633 | A | 11/1978 | Vander Lugt, Jr. | |
| 4,268,530 | A | 5/1981 | Wyslotsky | |
| 4,496,354 | A | 1/1985 | Steer et al. | |
| 4,619,361 | A | 10/1986 | Thomas, Jr. | |
| 4,664,922 | A | 5/1987 | Leon et al. | |
| 4,742,908 | A | 5/1988 | Thomas, Jr. et al. | |
| 5,061,501 | A | 10/1991 | Lowe | |
| 5,180,100 | A | 1/1993 | Shimizu | |
| 5,326,577 | A | 7/1994 | Warnock | |
| 5,660,868 | A | 8/1997 | Yeager | |
| 5,741,535 | A | 4/1998 | Cope et al. | |
| 5,839,572 | A | 11/1998 | Yeager | |
| 5,845,769 | A | 12/1998 | Yeager | |
| 5,871,095 | A | 2/1999 | Warnock et al. | |
| 5,888,565 | A | 3/1999 | Gics | |
| 6,110,512 | A | 8/2000 | Teasdale et al. | |
| 6,234,308 | B1 * | 5/2001 | Saffron et al. | 206/316.2 |
| 6,298,983 | B1 | 10/2001 | Yeager | |
| 6,588,594 | B2 * | 7/2003 | Andersen et al. | 206/497 |

FOREIGN PATENT DOCUMENTS

| | | |
|---|---|---|
| DE | 31 14 508 A1 | 11/1982 |
| FR | 2 796 256 A1 | 1/2001 |

* cited by examiner

*Primary Examiner*—David T. Fidei
(74) *Attorney, Agent, or Firm*—Alston & Bird LLP

(57) ABSTRACT

A compact and stackable package for displaying and protecting products including a transparent platform member having a planar portion on which a product may be placed, and a base portion at right angles to the planar portion on which the product is supported and which has a cavity or well therein in which an absorbent material, anti-microbial agent or atmosphere modifying agents may be placed, an overwrap of plastic film unitizing the platform member and product, and a sleeve member at least partially surrounding the periphery of the unitized platform member and product and on which indicia may be printed.

23 Claims, 4 Drawing Sheets

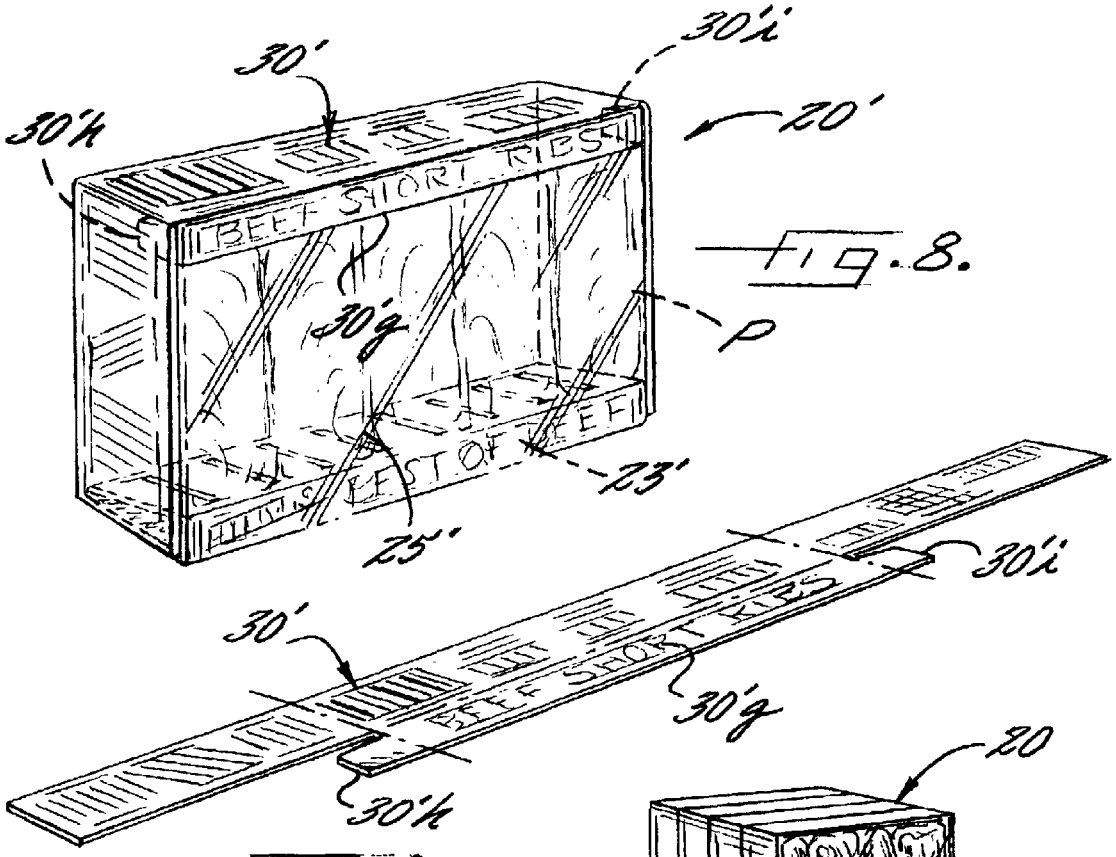
Fig. 8.
Fig. 9.
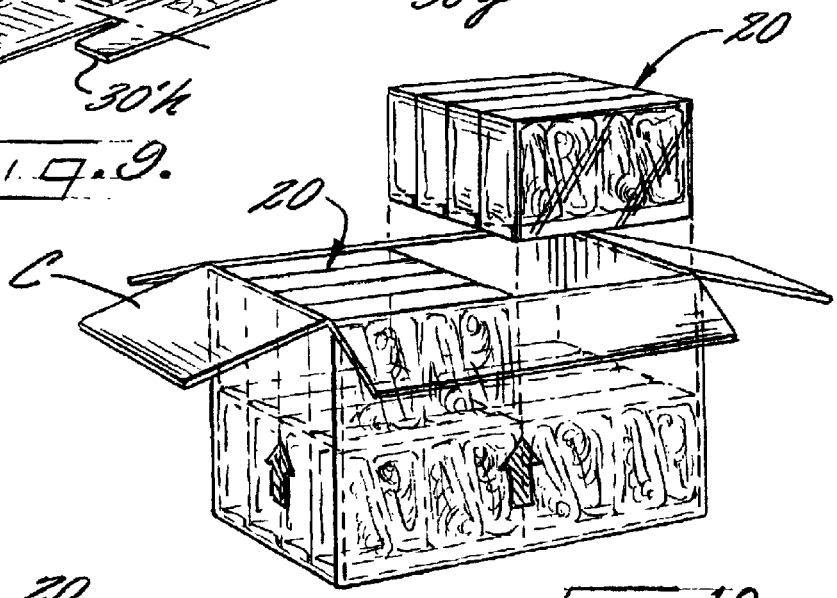
Fig. 10.
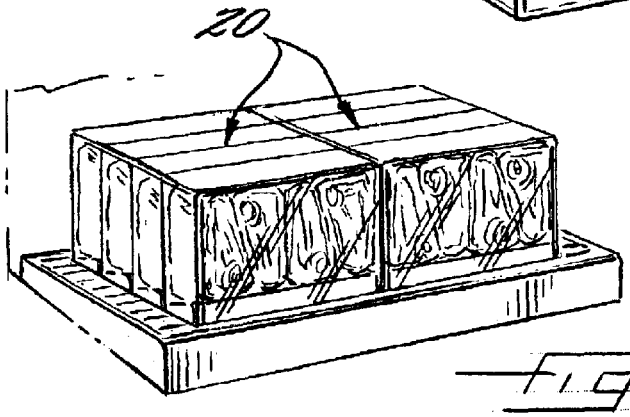
Fig. 11.

PACKAGE FOR DISPLAYING PRODUCTS

FIELD OF THE INVENTION

The present invention relates to packaging and more particularly to a compact and stackable package for displaying products.

BACKGROUND OF THE INVENTION

Most fresh meat, fish and poultry products sold at retail are packaged in trays formed of wood fibers, paperboard, plastic foam or thermoform plastic sheet material. An absorbent pad is frequently placed in the tray to absorb fluids which exude from the product. The tray and product is then overwrapped with a transparent plastic film. Examples of such packages are disclosed in U.S. Pat. Nos. 3,575,287; 3,700,096 and 4,664,922.

Sometimes, the product is placed in a plastic bag and sealed. Examples of this type of package are disclosed in U.S. Pat. Nos. 4,619,361; 4,742,908; and 5,660,868.

Prepared meats, etc., are packaged in a variety of blister-packs, specialty packs and the like. Examples of this type of packaging are disclosed in U.S. Pat. Nos. 4,125,633; 4,268,530; 4,496,354; 5,061,501; 5,326,577; 5,871,095; 5,888,565 and 6,110,512.

Sellers prefer to offer attractive packages which display the products and have informative and eye-catching indicia and graphics that attract and convince customers and consumers to purchase the products. Sellers also prefer packaging which permits them to brand their products and differentiate their products from competitors products.

Consumers prefer neat, clean and attractive packages which contain informative indicia and graphics. Most of all, however, purchasers want to see the products they are buying to the maximum extent possible.

Heretofore, trays and other packaging materials, except for the overwrap film, have not been transparent and therefore cover and obscure the consumer's view of the product. Attempts have been made to provide transparent windows, but such typically expose only a minor amount of the product. Even where transparent film would otherwise have exposed a significant amount of the product, printed indicia, labels and the like have prevented an uninterrupted view of the products.

Another major disadvantage of prior packaging is that such packaging has almost universally been of irregular size and shape. Both producers and consumers prefer packages of uniform shape and size which are much easier to pack and inventory. Most, if not all, of the packages heretofore in use have been of irregular shape and size, and therefore have been difficult to stack and display. Indeed, the shapes of such prior packaging have dictated that such packages be displayed in horizontal display cases. These refrigerated cases are inefficient, costly and are difficult for consumers to access.

Such prior packaging frequently will leak exudates into the display cases creating an unsightly mess and necessitating frequent cleaning or onto consumers hands or into carrying bags or containers. Such propensity is decidedly disadvantageous and causes consumer dissatisfaction.

BRIEF SUMMARY OF THE INVENTION

With the foregoing in mind, it is an object of the present invention to provide a package for displaying products that is neat, clean, attractive, regular in size and shape, provides good visibility of the product, permits branding and product differentiation, and therefore obviates the deficiencies and disadvantages of prior packaging.

The present invention accomplishes this objective by providing a package of a size and shape which is readily stackable and displays the product in either vertical or horizontal orientation. The package of the present invention includes a platform member having a generally rectangular, transparent planar portion on which the product is placed and supported, and a base portion at substantially a right angle to the planar portion for supporting the platform member with the planar portion in a substantially vertical orientation and for supporting the product thereon. The base portion may be integral with the planar portion or removably attached thereto. The platform member may include a top portion opposite said base portion and substantially parallel thereto. The base portion may include a well or cavity therein, in which an absorbent material may be placed to absorb exudants from the product. This well may also contain anti-microbial agents and/or carbon dioxide generators/oxygen removing agents.

A sleeve member encircles the platform member and the product to ensure the package has a regular cubic shape and to provide surfaces for printed indicia and advertising, marketing, or informational printing thereon. Preferably, the sleeve is formed of an elongate paperboard or plastic member having a width substantially equal to the width of the base portion of the platform member and at least as great as the thickness or height of the product such that the weight of superposed packages will be borne by the sleeve member and not the product. The sleeve member may be provided with a tear strip to aid in the removal thereof when the product is to be removed from the package.

The package of the present invention further includes a transparent plastic film overwrap, which may be a stretch or shrink film, which is wrapped around the platform member and product to unitize the same. If desired, the sleeve member may be applied before the film overwrap, but it is preferred that the sleeve member encircles the platform member, product and film overwrap. The film overwrap should be adhered or heat-sealed at least to the front and sides of the base portion and to the perimeter of the platform member, but should not obstruct the visibility of the product through the transparent planar portion of the platform member.

Preferably, the platform, product, film overwrap and sleeve member may be over-wrapped in plastic film, shrink wrap or lidded by plastic film. This overwrap provides a second barrier to the escape of exudates from the package and renders the package more leak-proof.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

FIG. 8 is a view similar to FIG. 1 of another embodiment of the package of the present invention;

FIG. 9 is a perspective view of the sleeve member shown in FIG. 8;

FIG. 10 is a perspective view of a carton being packed with packages of the present invention;

FIG. 11 is a perspective view of a typical display case containing the packages of the present invention;

DETAILED DESCRIPTION OF THE INVENTION

The present inventions now will be described more fully hereinafter with reference to the accompanying drawings, in which some, but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
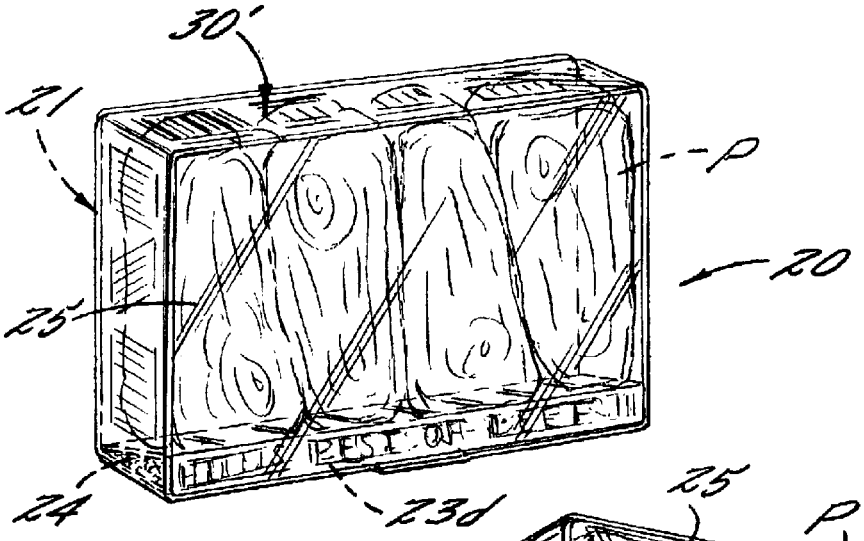
FIG. 1 is a frontal perspective view of a package according to the present invention.
Figure 2:
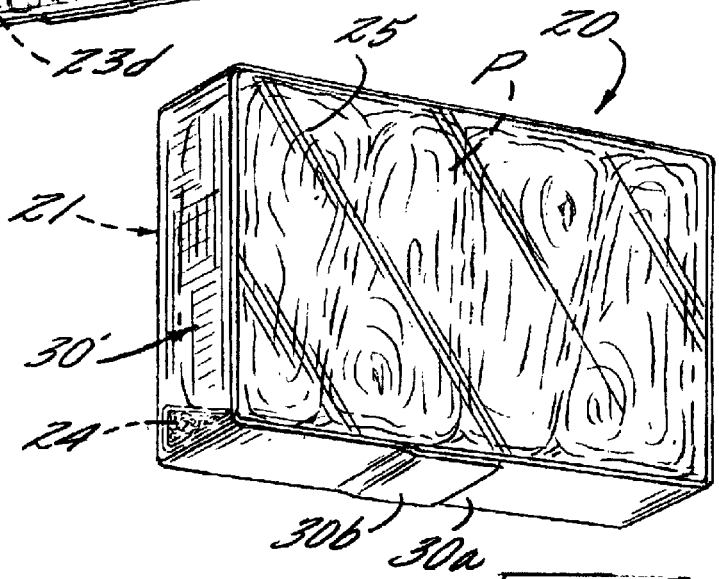
FIG. 2 is a view similar to FIG. 1, but showing the bottom of the package of FIG. 1.
Figure 3:
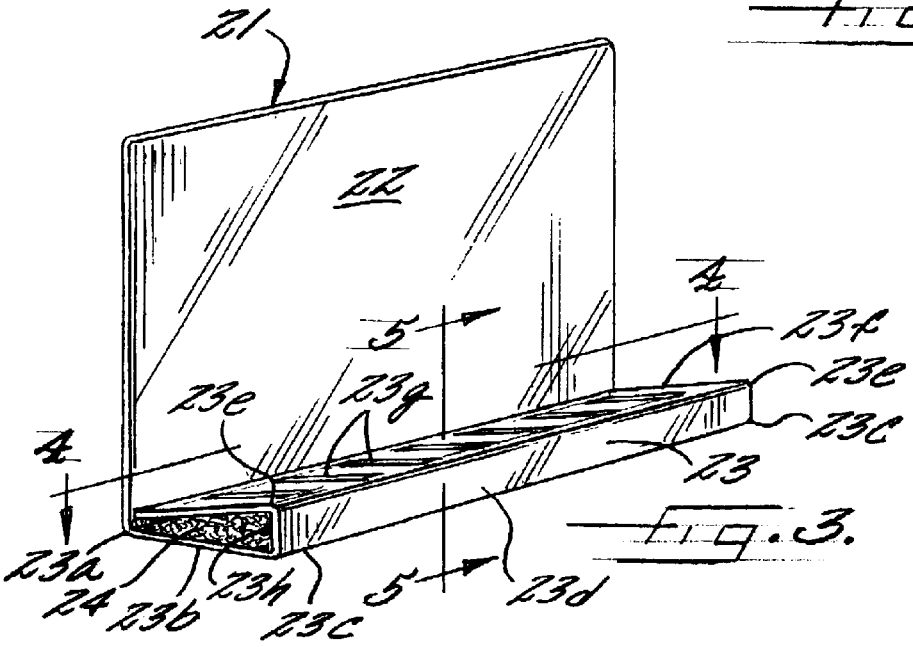
FIG. 3 is a frontal perspective view of the platform member of the package of the present invention.
Figure 4:
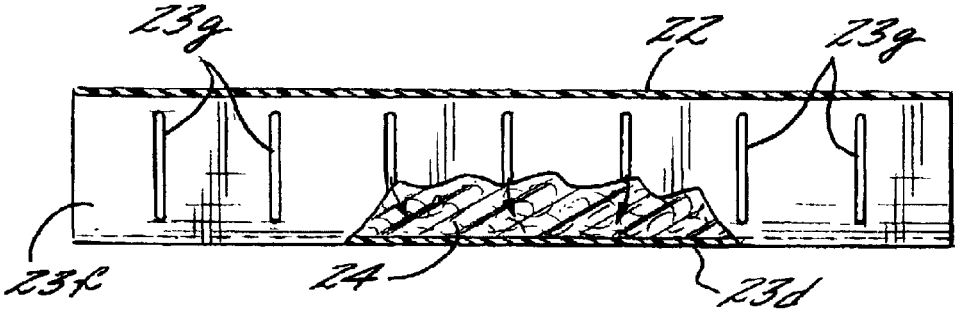
FIG. 4 is a sectional view taken substantially along line 4—4 in FIG. 3.

Referring now more particularly to the drawings, there is illustrated a package, generally indicated at 20, incorporating the features of the present invention (FIGS. 1 and 2). Package 20 includes a platform member, generally indicated at 21 (FIG. 3), which is formed of a sheet of thermoplastic material having sufficient rigidity and structural integrity to resist bending and to support and protect the product P during packing, shipment, storage and handling.

Platform member 21 includes a generally rectangular planar portion 22 and a base portion 23. Base portion 23 is preferably formed by thermoforming, i.e., heating, bending and cooling, the sheet of thermoplastic material along a first fold line 23*a* to provide a base portion segment 23*b* extending outwardly at substantially a right angle to planar portion 22. Next, the thermoplastic sheet is bent along a second fold line 23*c* to provide a base portion face segment 23*d* extending upwardly, substantially parallel to planar portion 22, and then is bent along a third fold line 23*e* to provide a base portion support segment 23*f* extending toward planar portion 22 from the base portion face segment 23*d*. Preferably, base portion support segment 23*f* extends toward planar portion 22 at a small declining angle. Base segments 23*b* and 23*f* preferably have a width between planar portion 22 and base portion face segment 23*d* at least as great as the thickness of the product P so that the product P will not extend outwardly beyond base portion face segment 23*d*.

Base portion support segment 23*f* preferably has perforations or slots 23*g* formed therethrough so that liquids exuding from the product P may pass therethrough and collect in the space or well 23*h* between base portion segments 23*b* and 23*f*. The well 23*h* extends the full length of the planar portion 22 and the length thereof is determined by the cubic volume needed to contain the exudants and other liquids normally encountered with each particular product being packaged.

Preferably, an absorbent material 24 is contained within well 23*h* to absorb any exudants or other liquids draining into well 23*h*. The absorbent material 24 may be plant fibers, desiccants, super-absorbents, etc., which are well known to persons skilled in the packaging arts. Additionally, antimicrobial agents, deodorants or oxygen scavengers with or without accompanying carbon dioxide generators may be included in well 23*h*.

The product P, such as, for example, beef steaks, are placed on platform member 21 with one major surface against planar portion 22 and one edge resting on base portion support segment 23*f* which functions as a shelf on which the product P is supported. A transparent thermoplastic film overwrap 25 is then applied to unitize the product P and platform member 21. While the film overwrap 25 may completely enclose the platform member 21 and the product P, it is preferred that the film overwrap 25 only extend over the product P and into contact with the periphery of the platform member 21, including the top and ends of the planar portion 22 and the ends and face segments 23*d* of base portion 23, to which the overwrap 25 is secured or heat-sealed.

Figure 6:
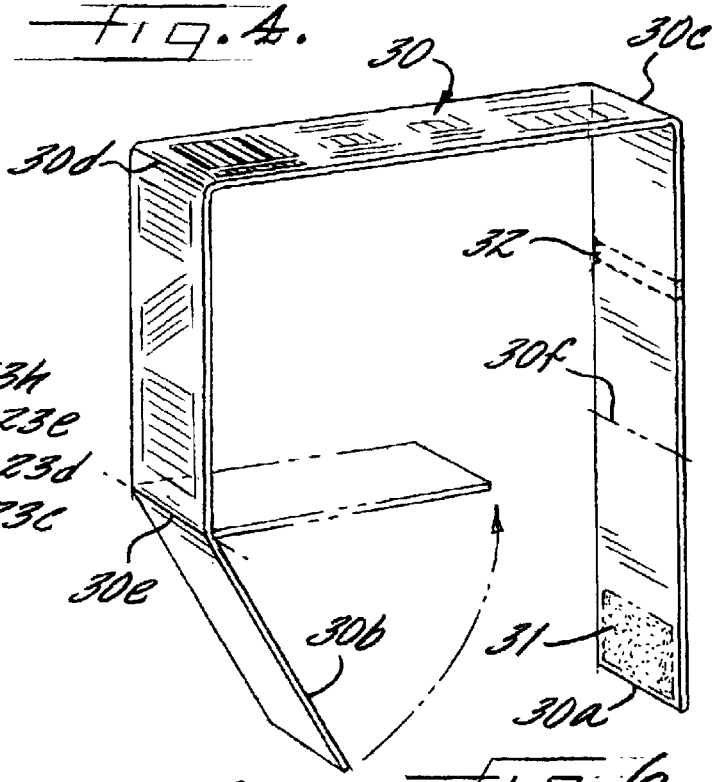
FIG. 6 is a perspective view of the sleeve member of the package of FIG. 1 illustrating the folding thereof.

A sleeve member 30 is formed of an elongate strip of paperboard, plastic or other material which is readily printable and which has sufficient rigidity to support other packages stacked thereon (FIG. 6). Sleeve member 30 has a width at least as great as the width of base portion 23 of platform member 21 and a length slightly greater than the circumference of the package 20 so that opposite end portions 30*a* and 30*b* overlap. An adhesive 31 is provided to secure the opposite end portions 30*a* and 30*b* together. Preferably, sleeve member 30 is provided with a tear strip 32 for ease of removal of sleeve member 30 when the product is to be removed.

Sleeve member 30 has four fold lines 30*c*, 30*d*, 30*e* and 30*f* therein at locations corresponding to the corners of the platform member 21. In use, sleeve member 30 is wrapped around the periphery of the platform member 21, the product P and overwrap 25 and it's opposite end portion 30*a* and 30*b* are overlapped and secured together by adhesive 31 (FIG. 2). Sleeve member 30 may have indicia printed thereon, including but not limited to, product description and contents, marketing information, source identification, etc.

Figure 5:
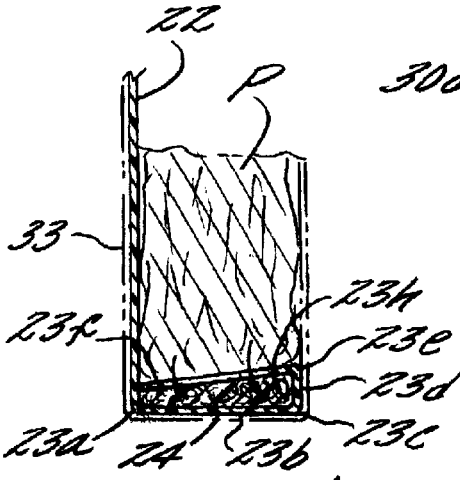
FIG. 5 is a fragmentary sectional view taken substantially along line 5—5 in FIG. 3.

Preferably, an additional overwrap 33 (FIG. 5) of plastic film, such as stretch or shrink film, may be used to protect the sleeve member 30 and retain the sleeve member 30 in place, and to form an additional barrier to leakage of exudates from the package 20. Alternatively, sleeve member 30 may be adhered or otherwise attached to the platform member 21 or first overwrap 25.

Figure 7:
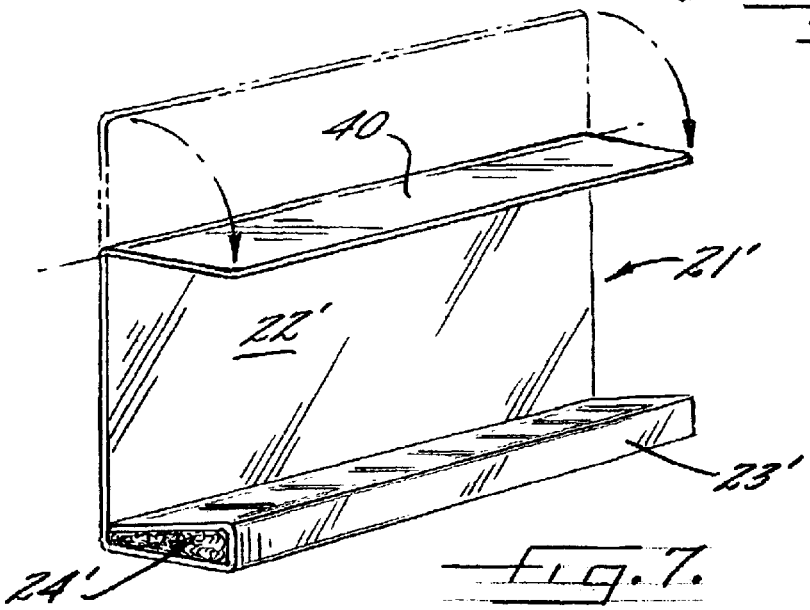
FIG. 7 is a perspective view similar to FIG. 3 of another embodiment of the platform member of the package of the present invention.

Referring now to FIGS. 7–9, there is illustrated another embodiment of the package of the present invention with like reference characters with the prime notation added referring to like components. In FIG. 8, there is illustrated a package, generally referred to at 20', which includes a platform member, generally referred to at 21'. Platform member 21' is substantially similar to platform member 21, with a planar portion 22' and a base portion 23'. In addition, platform member 21' has a top portion 40 which extends outwardly from planar portion 22' parallel to base portion 23' and for substantially the same distance. Therefore, the product will be enclosed by the platform member 21' on the top, bottom and one side for extra protection.

As with package 21, a unitizing overwrap 25' of plastic film is used to enclose the open front and opposite ends of the platform member 21'. The overwrap 25' may completely enclose the platform member 21', but preferably overwrap 25' is adhered to the periphery of platform member 21' and therefore covers only the open space occupied by the product.

A partial sleeve member 30' extends from one end of base portion 23' upwardly, across top portion 40 and downwardly to the other end of base portion 23'. Preferably, sleeve member 30' is adhered to platform member 21' at least at the opposite ends of base portion 23'. Sleeve member 30' includes a projecting portion 30'*g* extending outwardly from the medial portion of sleeve member 30'. Projecting portion 30'*g* has tab portions 30'*h* and 30'*i* at its opposite ends. Tab portions 30'*h* and 30'*i* are not connected to the remainder of the sleeve member 30'.

Projecting portion 30'*g* is folded downwardly over the front edge of top portion 40 of platform member 21' in front of the top portion of the product receiving open space. Projecting portion 30'*g* thus provides a convenient and very visible banner for printing indicia to draw attention to the product. The tab portions 30'*h* and 30'*i* are folded rearwardly inside the end portions of sleeve member 30' and to which they may be adhered. A final overwrap 33' of plastic film completes the package 20'.

FIG. 10 illustrates the manner in which packages 20 or 20' may be packed in a carton C while maximizing the use of available space therein and still protecting the product.

FIG. 11 illustrates the display of the products in packages 20 or 20' in an upright or vertical orientation as opposed to the limited horizontal orientation of prior packages.

Figure 12:
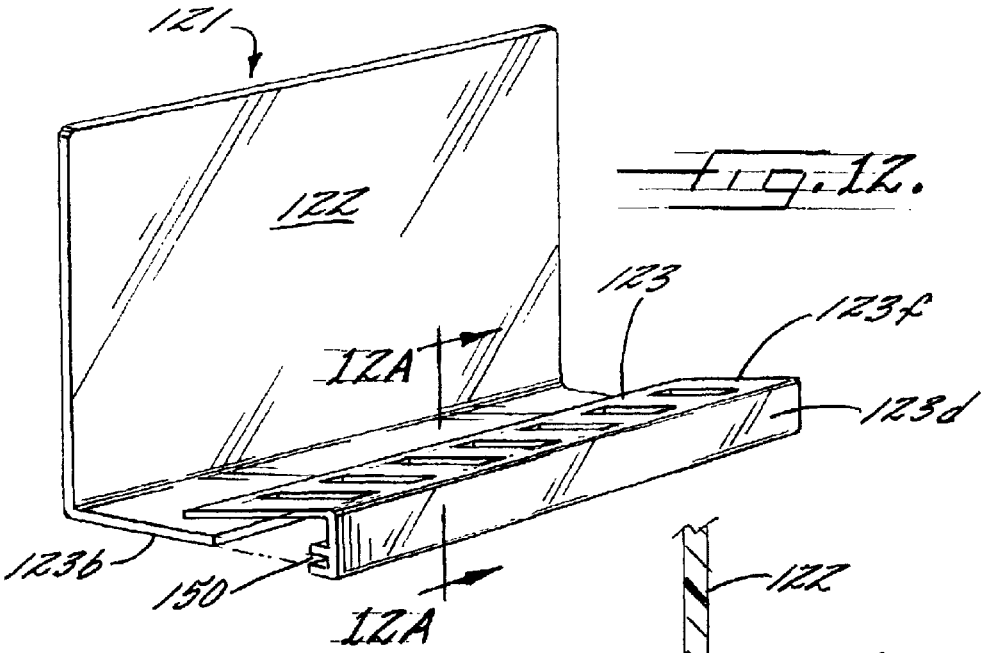
FIG. 12 is a perspective view similar to FIG. 3 of a further embodiment of the platform member of the present invention.
Figure 12A:
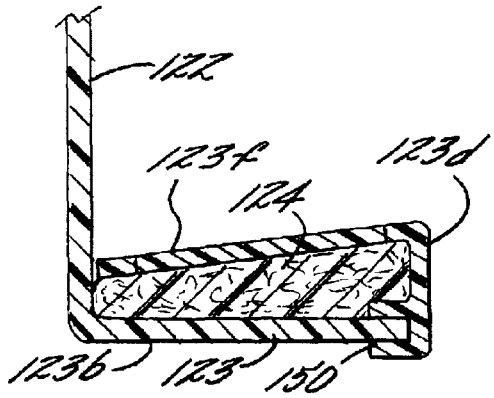
FIG. 12A is a fragmentary sectional view taken substantially along line 12A—12A in FIG. 12.

Referring now to FIGS. 12 and 12A, there is illustrated a further embodiment of the present invention in which like reference characters with the prefix "1" are used to refer to like elements. A platform member, generally referred to as 121, includes a planar portion 122 and a base portion 123. Base portion 123 includes a base portion segment 123*b*.

In this embodiment, base portion 123 is bifurcated or formed in two parts with one part being removably connected to base portion segment 123*b*. A base portion face segment 123*d* has a female receptacle connector portion 150 which receives the outer free end portion of the base portion segment 123*b* therein to connect removably the two segments together. A base portion support segment 123*f* completes the base portion 123.

Figure 13:
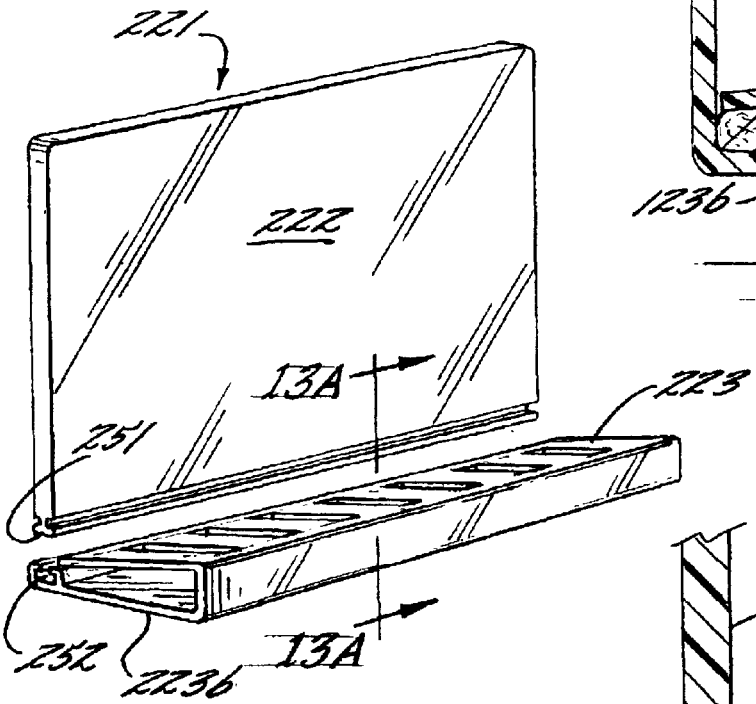
FIG. 13 is a perspective view similar to FIGS. 3 and 12 of a still further embodiment of the platform member of the present invention.
Figure 13A:
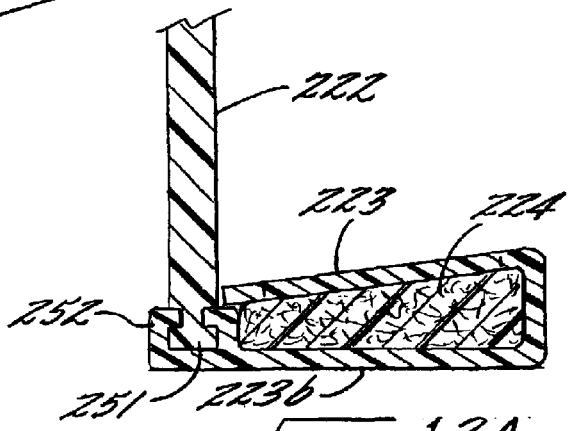
FIG. 13A is a fragmentary sectional view taken substantially along line 13A—13A in FIG. 13.

Referring now to FIGS. 13 and 13A, there is illustrated a still further embodiment of the present invention in which like reference characters with the prefix "2" added are used to refer to like elements. A platform member, generally indicated at 221, includes a planar portion 221, which terminates at its bottom edge in a male connector portion 251, and a base portion 223. Base portion 223 includes a base portion segment 223*b* which includes at its inner edge a female connector portion 252. Male connector portion 251 is received in female connector portion 252 to connect removably the two segments together.

Base portions 123 and 223 are adapted to receive and contain absorbent material 124 and 224, respectively, for absorbing and containing exudates and other liquids. While not specifically illustrated, it should be understood that platform members 121 and 221 will receive products thereon and will be used with the other elements of the package of the present invention.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A stackable package for displaying consumer products comprising:

a platform member having a substantially planar portion on which the product may be placed and supported, and a base portion at one side edge of said planar portion and extending laterally outwardly therefrom, said base portion being adapted to support the product thereon and to support said platform member on a surface with said planar portion disposed in a substantially vertical orientation, and said base portion including a well or a cavity, a transparent plastic wrap covering the product and at least a portion of said platform member to secure the product on said platform member, and a sleeve member extending around the periphery of said platform member and being secured thereto to encircle at least a portion of said platform member and the product and impart a cubic form to said package, said sleeve member being formed of a material having an outer surface on which indicia may be readily printed.

2. A package according to claim 1 wherein said platform member is formed of a transparent plastic material and has a sufficient rigidity to support the consumer product without significant bending or other deformation.

3. A package according to claim 1 wherein said sleeve member is on the outside of the transparent plastic wrap.

4. A package according to claim 1 including an absorbent material in said well or cavity in said base portion of said platform member for absorbing excess moisture or fluids within said package.

5. A package according to claim 4 wherein said base portion includes a bottom member extending outwardly from said planar portion, an outer member connected to said bottom member and extending substantially parallel to said planar portion and an upper member connected to said outer member, and extending toward said planar portion in spaced relation to said bottom member to define said well or cavity therebetween.

6. A package according to claim 5 wherein said upper member is perforated to permit exudants to pass through said upper member into said well or cavity.

7. A package according to claim 5 wherein said upper member extends toward said planar portion at a declining acute angle to the horizontal.

8. A package according to claim 1 wherein said sleeve member and said base portion of said platform member each define a width which is generally perpendicular to said planar portion and wherein the width of said sleeve member is at least equal to the width of said base portion of said platform member and at least as great as the thickness of the consumer product so that said sleeve member bears the weight of any superposed package or packages stacked thereon.

9. A package according to claim 1 wherein said platform member includes a top member at the upper edge of said planar portion and extending outwardly therefrom so as to be substantially parallel to said base portion.

10. A package according to claim 1 wherein said sleeve member comprises an elongate member with opposite end portions juxtaposed and secured together.

11. A package according to claim 10 wherein said elongate member includes a medial extension which is foldable downwardly to a position substantially parallel to said planar portion.

12. A package according to claim 1 further comprising a film overwrap which encloses said sleeve member, said platform member, and the product.

13. A package according to claim 1 wherein said planar portion and said base portion of said platform member are formed in two separate parts and includes means for removably connecting said parts and includes means for removably connecting said parts together.

14. A stackable package for displaying food products, comprising a platform member comprising a substantially planar portion of generally rectangular outline so as to define substantially parallel upper and lower edges and opposite side edges, and a base portion extending along said lower edge of said planar portion and generally perpendicular to said planar portion as to define a width dimension, a food product positioned to overlie said planar portion of said platform member and so as to be adapted to engage said base portion thereof, a transparent film wrap overlying the product on the side thereof opposite the planar portion of the platform member and engaging the platform member to secure the food product on the platform member, and a sleeve member comprising a strip of material which extends along at least the upper edge and the opposite side edges of the planar portion of the platform member, and with the sleeve member having a width which generally equals the width dimension of the base portion, and such that the portion of the sleeve member which extends along the upper edge of the planar portion, and the base portion of the platform member, form generally parallel surfaces which permit a plurality of the packages to be vertically stacked with the planar portions of the platform members being disposed in a generally vertical orientation, or horizontally stacked with the planar portions disposed generally horizontally.

15. The package according to claim 14 wherein said base portion of said platform member includes a bottom member extending outwardly from said planar portion, an outer member connected to said bottom member and extending substantially parallel to said planar portion, and an upper support member connected to said outer member and extending toward said planar portion in spaced relation to said bottom portion member to define a well therebetween.

16. The package according to claim 15 further comprising an absorbent material disposed in said well for absorbing fluids exuded from the food product.

17. The package according to claim 16 wherein said upper member of said base portion is perforated to permit fluids exuded from the food product to pass therethrough to said absorbent material.

18. The package according to claim 14 further comprising a transparent film overwrap which is secured to the platform member so as to overlie the transparent film wrap and the sleeve member.

19. The package according to claim 14 wherein said platform member further comprises a top portion extending along said upper edge and outwardly from said planar portion so as to be generally parallel to said base member, and such that the sleeve member overlies said top portion.

20. The package according to claim 14 wherein said sleeve member is formed in one piece with opposite end portions which overlap each other below said base portion of said platform member, and with the overlapping end portions being adhered together.

21. The package according to claim 1 wherein the sleeve member is adhered to the platform member or to the transparent film wrap.

22. A stackable package for displaying consumer products comprising:

a platform member having a substantially planar portion on which the product may be placed and supported, and a base portion at one side edge of said planar portion and extending laterally outwardly therefrom, said base portion being adapted to support the product thereon and to support said platform member on a surface with said planar portion disposed in a substantially vertical orientation, a transparent plastic wrap covering the product and at least a portion of said platform member to secure the product on said platform member, a sleeve member extending around the periphery of said platform member and being secured thereto to encircle at least a portion of said platform member and the product and impart a cubic form to said package, said sleeve member being formed of a material having an outer surface on which indicia may be readily printed, and a film overwrap which encloses said sleeve member, said platform member, and the product.

23. The package according to claim 22 wherein said base portion of said platform member includes a well or cavity, and wherein an absorbent material is retained in said well or cavity for absorbing excess moisture or fluids within said package.

* * * * *

UNITED STATES PATENT AND TRADEMARK OFFICE

CERTIFICATE OF CORRECTION

PATENT NO. : 6,796,423 B2
DATED : September 28, 2004
INVENTOR(S) : Miller

It is certified that error appears in the above-identified patent and that said Letters Patent is hereby corrected as shown below:

Column 8,
Line 24, "claim 1" should read -- claim 14 --.

Signed and Sealed this

Eighth Day of February, 2005

JON W. DUDAS
*Director of the United States Patent and Trademark Office*